US006342148B1

(12) United States Patent
Chiu et al.

(10) Patent No.: US 6,342,148 B1
(45) Date of Patent: Jan. 29, 2002

(54) TIN ELECTROPLATING BATH

(75) Inventors: See Hong Chiu, Brooklyn, NY (US); Yun Zhang, Warren, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/296,574

(22) Filed: Apr. 22, 1999

Related U.S. Application Data

(60) Provisional application No. 60/110,722, filed on Dec. 3, 1998.

(51) Int. Cl.[7] ..... C25D 3/32
(52) U.S. Cl. ..... 205/302; 205/254
(58) Field of Search ..... 205/302, 303, 205/254, 304

(56) References Cited

U.S. PATENT DOCUMENTS 4,310,392 A 1/1982 Kohl
4,565,609 A 1/1986 Nobel et al.
4,565,610 A 1/1986 Nobel et al.
4,599,149 A 7/1986 Nobel et al.
4,617,097 A 10/1986 Nobel et al.
4,683,036 A * 7/1987 Morrissey et al. ..... 205/125
4,701,244 A 10/1987 Nobel et al.
4,871,429 A 10/1989 Nobel et al.
4,880,507 A 11/1989 Toben et al.
4,994,155 A 2/1991 Toben et al.
5,066,367 A 11/1991 Nobel et al.
5,094,726 A 3/1992 Nobel et al.
5,174,887 A 12/1992 Federman et al.
5,750,017 A * 5/1998 Zhang ..... 205/102

* cited by examiner

*Primary Examiner*—Kathryn Gorgos
*Assistant Examiner*—Wesley A. Nicolas
(74) *Attorney, Agent, or Firm*—Lowenstein Sandler PC

(57) ABSTRACT

An electrolyte bath for plating tin or tin alloy onto metal substrates using a high speed plating process is described. The electrolyte bath contains a stannous alkyl sulfonate and an alkyl sulfonic acid. The bath also contains an organic compound that is the reaction product of polyalkylene glycol and phenolphthalein or derivatives of phenolphthalein.

7 Claims, No Drawings

TIN ELECTROPLATING BATH

PRIORITY APPLICATION INFORMATION

This application claim priority of Provisional Patent Application Ser. No. 60/110,722 filed Dec. 3, 1998 and entitled "Tin Electroplating Process."

BACKGROUND OF THE INVENTION

1. Technical Field

The process of the present invention is directed to a process for electroplating tin on metal substrates.

2. Art Background

Tin is known as a metal that has excellent corrosion resistance. Good soldered connections are formed on tin surfaces because an excellent bond forms between the tin and the solder. Furthermore, when tin is plated on metals such as steel, copper, aluminum, nickel, and alloys thereof, the tin plate provides corrosion resistance and solderability to these metal substrates. Tin plate coatings are typically soft and ductile.

The electrolytic tinning of steel strip to produce tin plate is known. Tin is plated on steel using high speed electroplating processes. In high-speed processes, the substrate passes through the electroplating bath quickly and the bath itself is subjected to vigorous agitation and solution circulation. High speed process for electroplating tin onto substrates is described in U.S. Pat. Nos. 4,994,155 and 4,880,507 to Toben et al. A high speed process for electroplating tin onto steel strips is described in U.S. Pat. No. 5,174,887 to Federman et al. In these processes, electroplating occurs in a bath that includes a basis solution of either an alkyl sulfonic acid or an alkoyl sulfonic acid. The bath also includes a surfactant that does not foam during electroplating. Low foaming surfactants are used to prevent overflow from the reservoir tank. Such overflow is detrimental because it wastes solution. Foam also adversely affects the pumps used to agitate and circulate the solution.

Electroplating bath compositions that are used in high speed electroplating processes must contain chemical constituents that are stable when subjected to the temperature and degree of agitation required for high speed electroplating. Furthermore, the chemical constituents of such baths must be stable when exposed to air, since the bath is open to ambient air during the process. The bath must be clear and free from turbidity over a wide range of temperatures and should therefore have a cloud point (i.e. the temperature below which the chemistries remain clear) above 54° C. (130° F). Baths should also operate at current densities at or above 500 ASF. Finally the electrodeposits provided by such baths should be highly reflective and be relatively defect free and remain defect free after being subjected to reflow conditions. Electrolytic bath chemistries that satisfy these conditions are sought.

SUMMARY OF THE INVENTION

The invention is an electrolytic bath, which is useful for electroplating tin onto steel under high speed electroplating conditions. High-speed electroplating conditions are described in U.S. Pat. No. 5,174,887 to Federman et al., which is hereby incorporated by reference. High-speed conditions for electroplating tin onto steel, and the apparatus used therefor, are well known to one skilled in the art and are not described in detail herein.

The electrolytic plating bath of the present invention is an aqueous solution of an alkyl sulfonic acid and a solution soluble tin compound. An example of a suitable alkyl sulfonic acid is methanesulfonic acid. An example of a solution soluble tin compound is tin methanesulfonate. The concentration of the alkylsulfonic acid in the bath is selected to provide a bath pH of about zero to about three. Concentrations of alkylsulfonic acid in the range of about 10 g/l to about 30 g/l are contemplated as suitable. Suitable concentrations of tin (as metal) are about 10 g/l to about 100 g/l. It is advantageous if the tin concentration is about 10 g/l to about 30 g/l. Although higher concentrations (i.e. concentrations as high as 100 g/l) of tin are technically feasible, these higher concentrations are not viewed as advantageous economically.

The solution also contains at least one organic additive that is the reaction product of a polyalkylene glycol and phenolphthalein and derivatives of phenolphthalein. In the reaction product, the number of alkylene oxide moieties (e.g. —$C_xH_YO$— wherein y equals 2x) is about 10 to about 62. The alkylene oxide moieties can be substituted or unsubstituted. In the embodiment of the present invention wherein the polyalkylene glycol is ethylene glycol, the alkylene oxide moieties are ethylene oxide moieties.

The condensation product is formed by reacting either a polyalkylene glycol with the phenolphthalein or phenolphthalein derivative. In one embodiment, the condensation product is formed before it is added to the electrolytic plating bath. In a second embodiment, the condensation product is formed in the electrolytic plating bath by separately adding to the bath: 1.) the alkylene glycol or polyalkylene glycol; and 2.) the phenolphthalein or phenolphthalein derivative.

The alkylene oxide is either substituted or unsubstituted. If substituted, methyl and ethyl substituents are contemplated as suitable. It is advantageous if the concentration of the organic additive (as condensation product) in the solution is about 0.2 g/l to about 2 g/l.

The solution also contains an antioxidant. Examples of suitable antioxidants include a sodium salt of benzaldehyde sulfonic acid and derivatives thereof. The concentration of the antioxidant in solution is about 0.15 g/l to about 1.5 g/l.

DETAILED DESCRIPTION

In the process of the present invention, the previously described plating solution is prepared by adding either stannous alkyl sulfonate or stannous alkoyl sulfonate to an aqueous solution of alkyl sulfonic acid or alkoyl sulfonic acid. Assuming 1 liter of the solution is being prepared, about 10 g to about 30 g tin (added as the stannous sulfonate) is added to one liter of an aqueous solution that contains about 10 g/l to about 30 g/l of alkyl or alkoyl sulfonic acid. To this solution is added at least about 0.2 g/l of an organic additive that is the condensation product of an alkylene glycol or polyalkylene glycol and phenolphthalein or phenolphthalein derivative. Phoenolphthalein has the following structure:

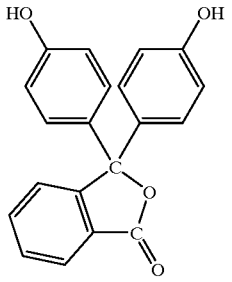

Examples of phenolphthalein derivatives include the following:

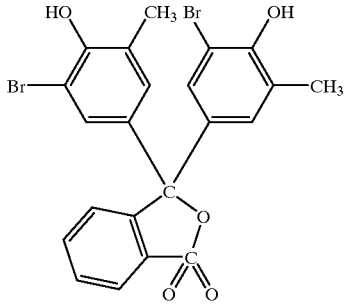

bromocresol purple

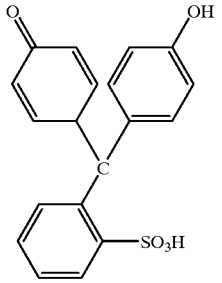

phenol red

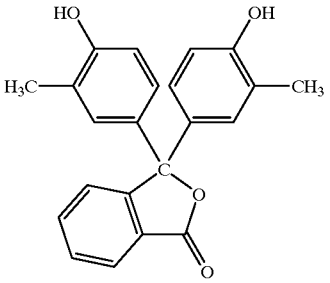

o-cresolphthalein and

-continued

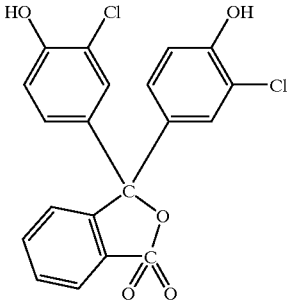

chlorophenol red

Concentrations of the organic additive above 0.2 g/l are contemplated as suitable. However, concentrations above about 2 g/l are not viewed as necessary because there is no additional benefit when the concentration of the organic additive exceeds about 2 g/l.

The structure of the reaction product of polyethylene glycol and phenolphthalein is illustrated by the following structure:

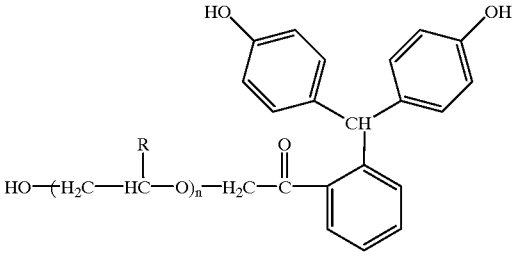

wherein n is about 10 to about 62 and R is hydrogen, methyl, or ethyl.

In one embodiment of the present invention, a solution is prepared that contains about 10 to about 30 g/l of tin added as tin methanesulfonate, about 10–30 g/l of methanesulfonic acid, about 0.2 to about 2 g/l of the condensation product of polyethylene glycol and phenolphthalein, and 0.15 g/l to about 1.5 g/l of an antioxidant. One example of a suitable antioxidant is the sodium salt of benzaldehyde sulfonic acid.

The electrolytic bath of the present invention is used to plate tin onto steel substrates at wide range of current densities. One advantage of the electrolytic bath of the present invention is that it provides good tin electrodeposits, using any current density that is currently used in high speed electroplating. Currently, current densities in the range of about 100 ASF to 700 ASF are used in high speed electroplating. However, the electrolytic bath of the present invention will provide good tin electrodeposits even if current densities higher than 700 ASF are used.

The temperature of the bath during electroplating is about 35° C. to bout 65° C. The electrolytic bath of the present invention is used in conjunction with conventional high-speed steel electroplating equipment. Such equipment operates at speeds on the order of 1500 feet per minute.

EXAMPLE 1

Solutions were prepared by adding stannous methane sulfonate (39 g/l; 15 g/l tin as metal) and methanesulfonic acid (15 g/l) to water. To this solution was added a condensation product of polyglycol 15-200 (which is a polyglycol copolymer that is obtained from the Dow Chemical Co.) and phenolphthalein. The condensation product was formed by adding a quantity of polyglycol sufficient to provide a concentration of 1.5 g/l in the above-described solution and a quantity of phenolphthalein sufficient to provide a concentration of 0.5 g/l in the above-described solution. The solution also contained benzaldehyde sulfonic acid (0.75 g/l) as an antioxidant.

In the first plating test a 600 ml solution was used to plate tin on a steel substrate using a hydrodynamically controlled Hull Cell (HCHC). The HCHC panels were plated with 15 amperes for 30 seconds. In the above mentioned current density range, i.e., from 100 ASF to 700 ASF, the deposits that were obtained exhibited a satin bright finish (80% reflectance reading with a glossmeter). The deposits became full bright (100% reflectance reading with a glossmeter) when subjected to reflow. The deposits were reflowed by placing a deposited foil in a conventional oven at a temperature of 238° C. for four minutes. The foil was then removed from the oven, air cooled, and examined under a scanning electron microscope.

In a second plating test a 500 ml solution was used to plate tin on a steel substrate using rotating cylinder electrodes. The current density was fixed at 100 ASF, 300 ASF, 500 ASF and 700 ASF. The rotating speed was 1000 rpm or 2000 rpm. The temperature of the bath was 54° C.(130° F.). The deposits that were obtained using the above-described plating conditions had a satin bright finish and the deposits were full bright when subjected to reflow (using the previously described reflow conditions).

In a third plating test a 303 liter solution was used to plate tin on a steel substrate using flow cell. The solution flow rate was 245 gallons per minute. The flow conditions were selected to provide the flow that would be used to plate tin on a steel strip traveling through the bath at a speed of 1500 feet per minute. The current densities were 100 ASF, 300 ASF, and 600 ASF. The temperature of the bath was either 49° C. (120° F.) or 54° C. (130° F.). The deposits that were obtained exhibited a satin bright finish after plating. The deposits were full bright when subjected to reflow using the previously described reflow conditions.

What is claimed is:

1. An electrolyte bath for depositing tin upon a substrate by high speed electroplating comprising:

an aqueous plating bath comprising a stannous sulfonate selected from the group consisting of stannous alkyl sulfonate and stannous alkoyl sulfonate, a sulfonic acid selected from the group consisting of alkyl sulfonic acid and alkoyl sulfonic acid, and at least one organic additive that is the reaction product of polyalkylene glycol and phenolphthalein or a phenolphthalein derivative, wherein the concentration of the sulfonic acid in the solution is sufficient to provide the bath with a pH of about 1 or less and the concentration of the organic additive in the bath is about 0.2 g/l to about 2 g/l.

2. The electrolyte of claim 1 wherein the phenolphthalein derivative is selected from the group consisting of bromocresol purple, phenol red, o-cresolphthalein and chlorophenol red.

3. The electrolyte of claim 2 wherein the polyalkylene glycol has about 20 to about 250 carbon atoms.

4. The electrolyte of claim 3 wherein the reaction product has the structure:

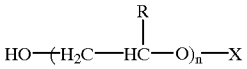

wherein X is the phenolphthalein or phenolphthalein moiety, R is selected from the group consisting of hydrogen, methyl and ethyl and n is about 10 to about 62.

5. The electrolyte of claim 1 wherein the reaction product has the structure:

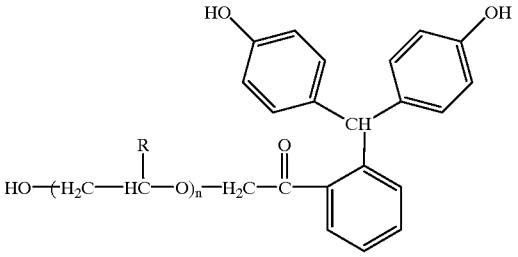

wherein n is about 10 to about 62 and R is hydrogen, methyl, or ethyl.

6. The electrolyte of claim 1 further comprising an antioxidant, wherein the concentration of the antioxidant in solution is about 0.15 g/l to about 1.5 g/l.

7. The electrolyte of claim 6 wherein the antioxidant is a sodium salt of benzaldehyde sulfonic acid and derivatives of benzaldehyde sulfonic acid.

* * * * *